US011885118B1

(12) United States Patent
Neiman et al.

(10) Patent No.: US 11,885,118 B1
(45) Date of Patent: Jan. 30, 2024

(54) GASKET FOR PREFABRICATED WALL PANEL SYSTEMS

(71) Applicant: Offsite Integrated Structures, LLC, Omaha, NE (US)

(72) Inventors: Brice Neiman, Overland Park, KS (US); Randy Schneewind, Excelsior, MN (US); Doug Stegemoller, Peoria, AZ (US)

(73) Assignee: CDM Capital Asset Group, Inc., Overland Park, KS (US)

( * ) Notice: Subject to any disclaimer, the term of this patent is extended or adjusted under 35 U.S.C. 154(b) by 234 days.

(21) Appl. No.: 17/462,685

(22) Filed: Aug. 31, 2021

Related U.S. Application Data

(60) Provisional application No. 63/073,773, filed on Sep. 2, 2020.

(51) Int. Cl.
*E04B 1/61* (2006.01)

(52) U.S. Cl.
CPC ..... *E04B 1/6158* (2013.01); *E04B 1/6179* (2013.01)

(58) Field of Classification Search
CPC ..... E04B 1/6179; E04B 1/6813; E04B 1/68; E04B 2/88; E04B 9/244; E06B 3/6202
USPC ..... 277/645
See application file for complete search history.

(56) References Cited

U.S. PATENT DOCUMENTS

| | | | | |
|---|---|---|---|---|
| 4,552,790 | A | 11/1985 | Francis | |
| 4,590,725 | A | 5/1986 | Kaminaga | |
| 4,616,460 | A * | 10/1986 | Nicholas | E04B 1/6815 52/396.01 |
| 4,782,636 | A | 11/1988 | Stoakes | |
| 4,861,043 | A * | 8/1989 | Anderson | E02B 3/16 404/66 |
| 4,866,896 | A | 9/1989 | Shreiner et al. | |
| 4,999,960 | A | 3/1991 | Herwegh et al. | |
| 5,687,524 | A | 11/1997 | Ting | |
| 5,709,056 | A | 1/1998 | Matsuyama et al. | |
| 5,893,244 | A | 4/1999 | Magoon | |
| 7,389,617 | B2 | 6/2008 | Grunewald | |
| 8,033,066 | B2 | 10/2011 | Griffiths | |
| 8,950,131 | B2 | 2/2015 | Loyd | |
| 9,340,969 | B1 * | 5/2016 | Shaw | B28B 1/14 |
| 2020/0256061 | A1 * | 8/2020 | Strickland | E04B 1/6813 |

FOREIGN PATENT DOCUMENTS

| | | | | |
|---|---|---|---|---|
| DE | 3305075 | A1 * | 8/1984 | |
| EP | 2169130 | A1 * | 3/2010 | E04B 1/6813 |
| GB | 1067976 | A * | 5/1967 | E04B 1/6813 |

* cited by examiner

*Primary Examiner* — Christine T Cajilig
(74) *Attorney, Agent, or Firm* — Mai D. Lauer; Westman, Champlin & Koehler P.A.

(57) ABSTRACT

A system includes a compressible, elongated gasket. The gasket includes first and second tubes aligned side-by-side and connected to each other along their common length by a first base and a second base, each of the first base and second base contacting both the first tube and the second tube. A method for sealing a joint between first and second wall panels is described. The method comprises obtaining a first compressible, elongated gasket; positioning the first gasket on an edge face of the first wall panel; attaching the first gasket to the edge face of the first wall panel; and placing the second wall panel adjacent to the first wall panel to compress the first gasket therebetween.

18 Claims, 12 Drawing Sheets

GASKET FOR PREFABRICATED WALL PANEL SYSTEMS

CROSS REFERENCE TO RELATED APPLICATION

This application claims the benefit of priority from U.S. Provisional Patent Application No. 63/073,773, filed Sep. 2, 2020. This priority application is hereby incorporated in its entirety.

BACKGROUND

Referring to FIGS. 1 and 2, Exterior Insulation and Finish System (EIFS) is a non-loadbearing, exterior wall cladding system that typically consists of panels having an insulation board attached to a substrate. Attachment of panels to each other may be accomplished by use of a chemical adhesive, friction, mechanical fastening, or combinations thereof.

The space between adjacent EIFS wall panels 10 should be sealed against air and moisture penetration at the joints 22 between panels 10. Conventionally, this is accomplished with caulking applied by workers from the exterior of the structure or building being constructed, often requiring the use of scaffolds and other support equipment. In the current state of the art, a backer rod is used to prevent sealants from penetrating too far into the joint, and sealant such as caulking material is applied at the joint. However, this method is labor intensive, cannot be applied during fabrication of the wall panel, and sometimes deteriorates over time, thereby requiring upkeep and replacement.

SUMMARY

In one aspect, a system comprises a compressible, elongated gasket. The gasket comprises first and second tubes aligned side-by-side and connected to each other along their common length by a first base and a second base, each of the first base and second base contacting both the first tube and the second tube.

In another aspect, a method for sealing a joint between first and second wall panels is described. The method comprises obtaining a first compressible, elongated gasket; positioning the first gasket on an edge face of the first wall panel; attaching the first gasket to the edge face of the first wall panel; and placing the second wall panel adjacent to the first wall panel to compress the first gasket therebetween.

This summary is provided to introduce concepts in simplified form that are further described below in the Detailed Description. This summary is not intended to identify key features or essential features of the disclosed or claimed subject matter and is not intended to describe each disclosed embodiment or every implementation of the disclosed or claimed subject matter. Specifically, features disclosed herein with respect to one embodiment may be equally applicable to another. Further, this summary is not intended to be used as an aid in determining the scope of the claimed subject matter. Many other novel advantages, features, and relationships will become apparent as this description proceeds. The figures and the description that follow more particularly exemplify illustrative embodiments.

BRIEF DESCRIPTION OF THE DRAWINGS

The disclosed subject matter will be further explained with reference to the attached figures, wherein like structure or system elements are referred to by like reference numerals throughout the several views. All descriptions are applicable to like and analogous structures throughout the several embodiments, unless otherwise specified.

While the above-identified figures set forth one or more embodiments of the disclosed subject matter, other embodiments are also contemplated, as noted in the disclosure. In all cases, this disclosure presents the disclosed subject matter by way of representation and not limitation. It should be understood that numerous other modifications and embodiments can be devised by those skilled in the art that fall within the scope of the principles of this disclosure. While some of the drawings show exemplary dimensions of features in inches, other sizes are also suitable.

The figures may not be drawn to scale. In particular, some features may be enlarged relative to other features for clarity. Moreover, where terms such as above, below, over, under, top, bottom, side, right, left, vertical, horizontal, etc., are used, it is to be understood that they are used only for ease of understanding the description. It is contemplated that structures may be oriented otherwise.

DETAILED DESCRIPTION

Figure 1:
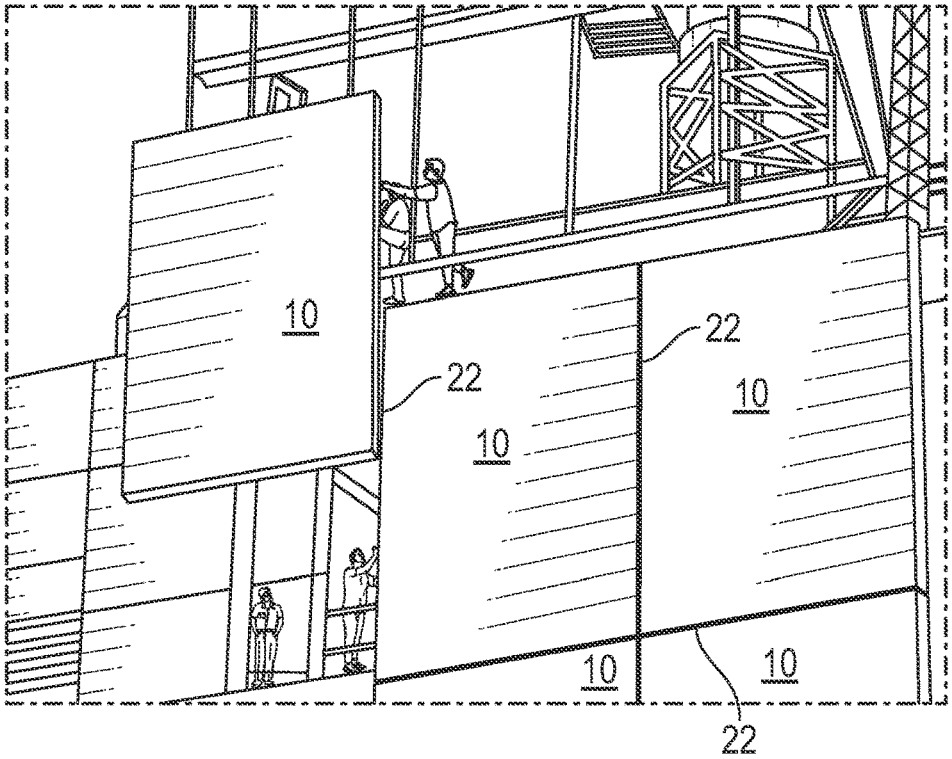
FIG. 1 (Prior Art)
FIG. 1 is an exterior view of EIFS wall panels being placed during construction of a building.
Figure 2:
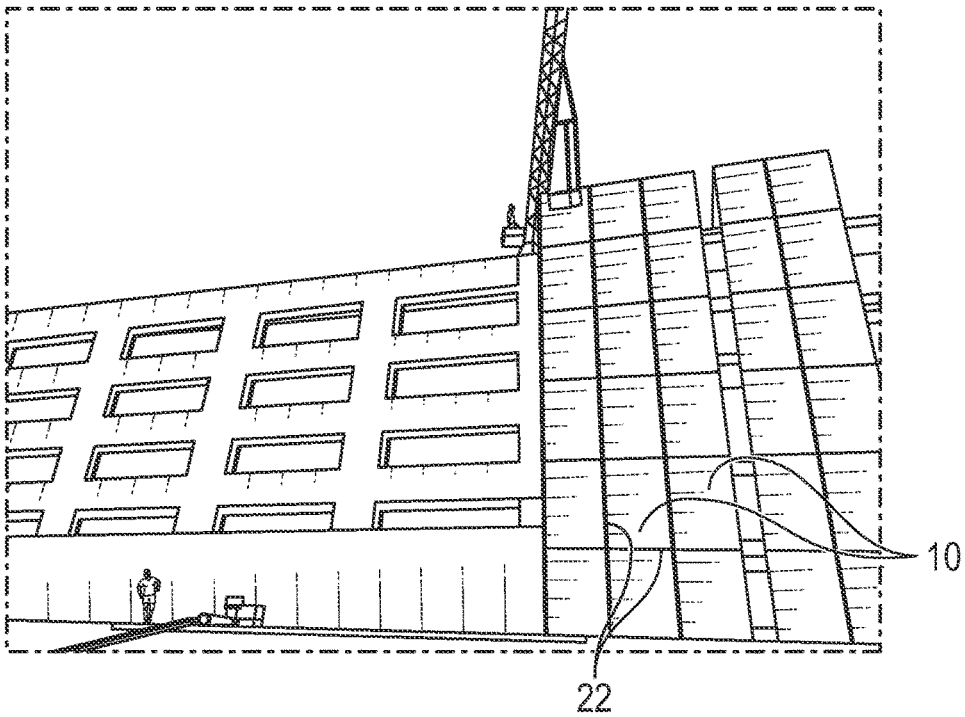
FIG. 2 (Prior Art)
FIG. 2 is a partial exterior view of a building with EIFS panels.
Figure 3:
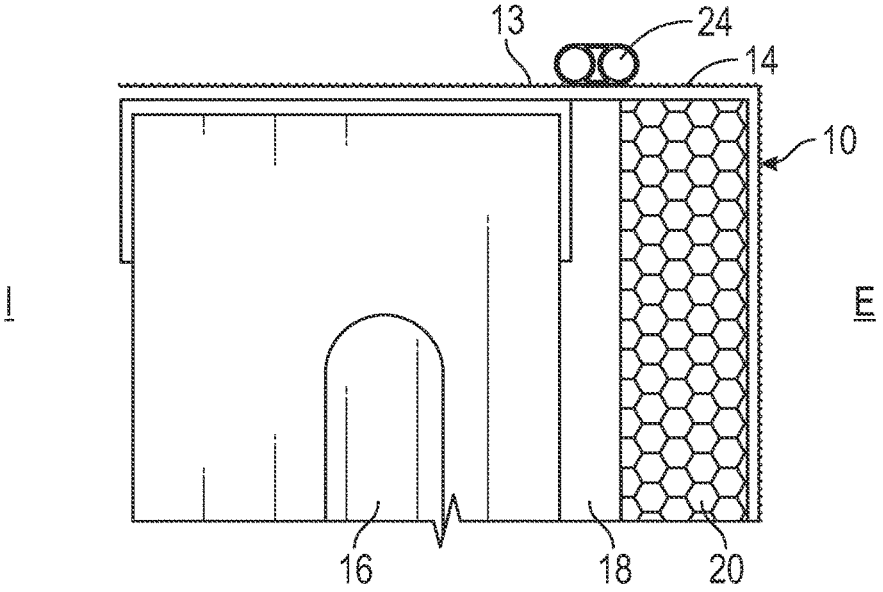
FIG. 3 is a partial side edge view of an exemplary wall panel with an exemplary gasket positioned thereon.

FIG. 3 is a partial side edge view of an exemplary wall panel 10 with an exemplary gasket 24 of the present disclosure positioned thereon. In an exemplary embodiment, gasket 24 has an elongated configuration in a length direction L shown in FIG. 5. In an exemplary embodiment, gasket 24 is affixed to edge face 13 of wall panel 10 at interface 14 such as by the use of a layer of pressure sensitive adhesive 26 (see FIG. 6) or other known means of attachment. In an embodiment, release liner 27 may be disposed over the adhesive 26 to allow for pre-installation application of adhesive while protecting it from contamination before use. In an exemplary embodiment, wall panel 10 is an assembly including stud 16, sheathing 18 and EIFS Many sizes of wall panels 10 are available, and thus gasket 24 may be sized accordingly. In an exemplary embodiment, gasket 24 has an uncompressed height dimension of about two inches.

Figure 4:
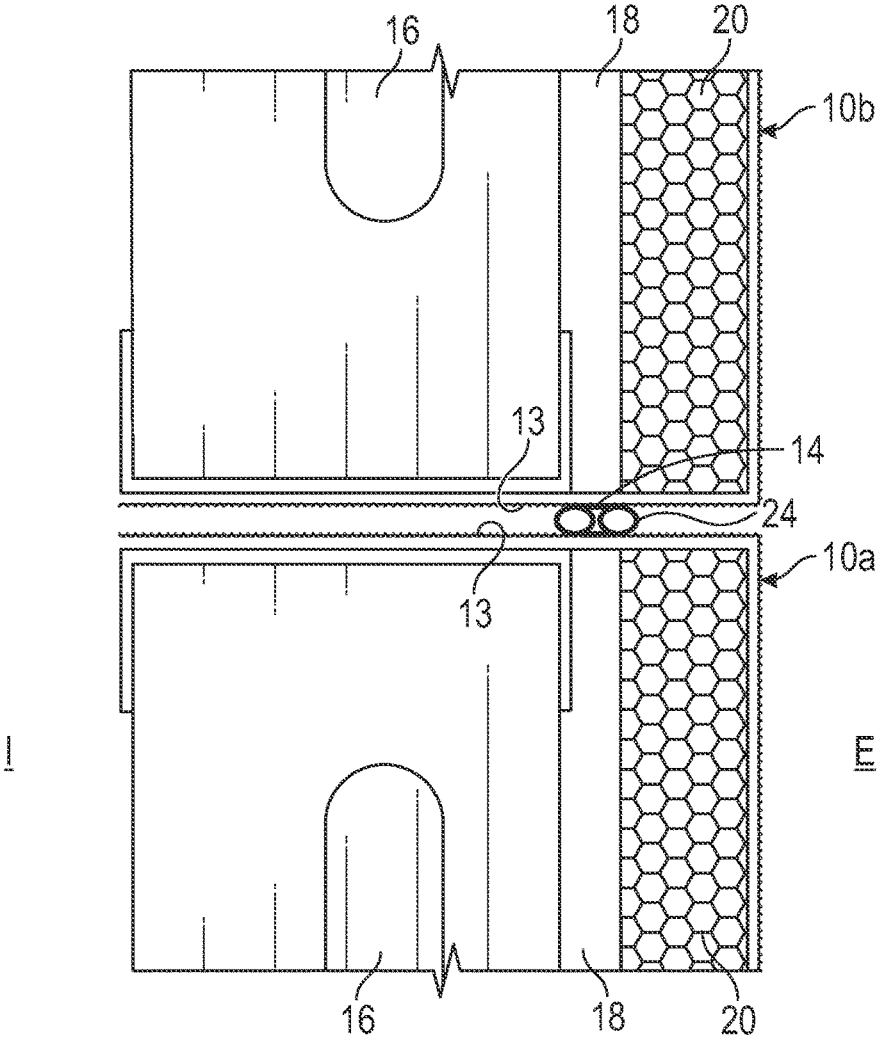
FIG. 4 is a partial side edge view of the wall panel of FIG. 3 with a second wall panel placed thereupon, thereby compressing the gasket.

As shown in FIG. 4, the wall panel 10 of FIG. 3 is designated as bottom wall panel and a second wall panel 10*b* is placed on top of bottom wall panel 10*a*. The weight of wall panel 10*b*, as well as adjacent panel installation parameters, compresses gasket 24 to the reduced height illustrated. In an exemplary embodiment, a compressed, installed height dimension of gasket 24 is about a half inch, and the compressed gasket (such as on panel 10*a*) engages a seal face 13 of an adjacent wall panel (such as panel 10*b*) along an engagement interface 14.

In an exemplary embodiment of a prefabricated wall panel 10, gasket 24 is attached to one or more edges 13 of the wall panel 10, such as a left side edge, a top edge, and a right side edge, for example. Upon installation of the multiple wall panels to each other, the facing edge faces of adjacent wall panels will compress the gaskets 24 therebetween. This compression seals a space in the joint 22 between the adjacent wall panels, thereby reducing or eliminating infiltration of environmental elements such as wind, precipitation and dust, for example. Thus, use of the disclosed gaskets with prefabricated wall panel systems allows for effective sealing between adjacent panels from environmental elements without requiring conventional methods such as the subsequent application of caulk or other sealing materials that typically require workers to scale scaffolding for their implementation.

Figure 5:
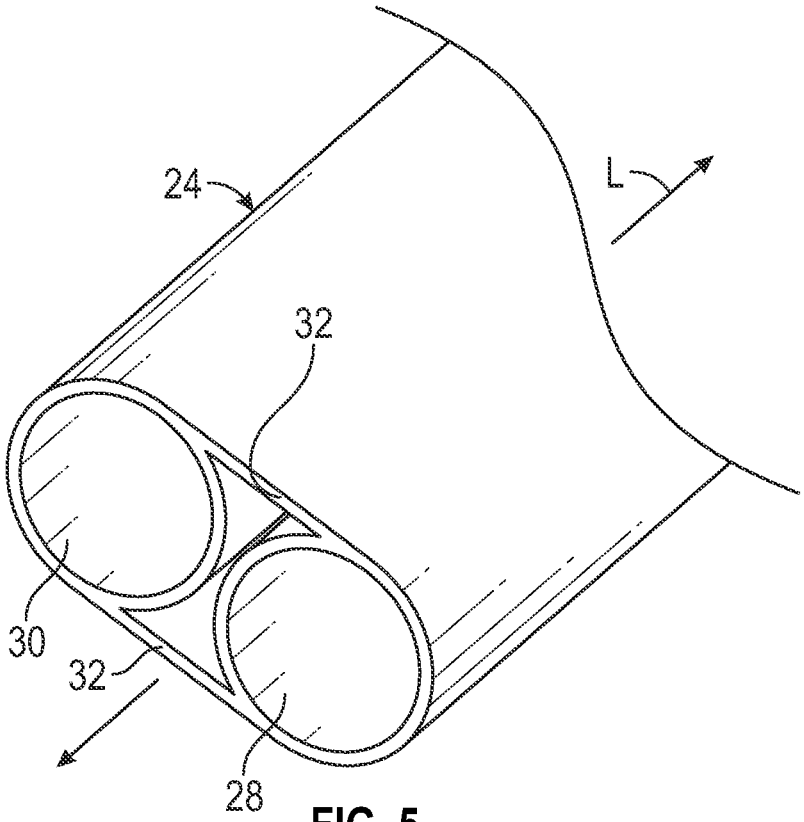
FIG. 5 is a partial perspective view of the exemplary gasket.
Figure 6:
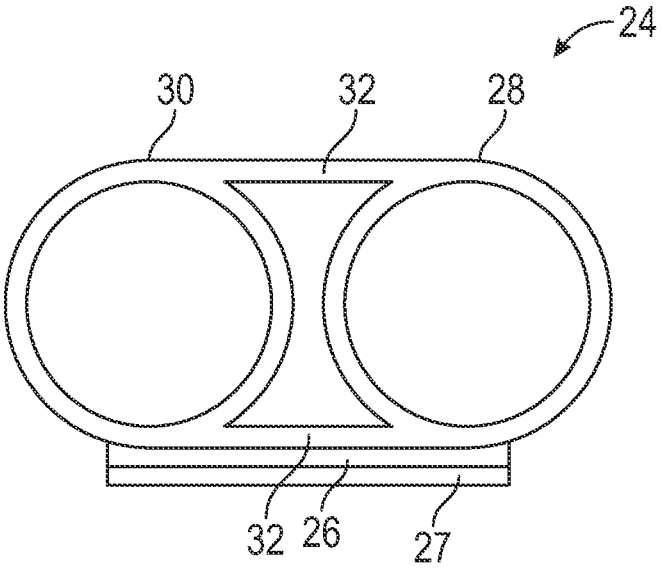
FIG. 6 is an end elevation view of the gasket of FIG. 5, with an adhesive layer and release liner thereon.

FIG. 5 is a partial perspective view of an exemplary gasket 24. FIG. 6 is an end elevation view of the gasket 24 of FIG. 5, with an adhesive layer 26 thereon. In FIG. 5, only a segment of gasket 24 is illustrated so that the shape thereof can be seen. It is to be understood that gasket 24 can have any length along dimension L, such as suitable lengths of 5,000 feet, 10,000 feet, or 20,000 feet, for example. While gasket 24 can be manufactured in just about any length L, for practical considerations in handling and storage, gasket 24 will be cut to lengths such as ten feet, for example. In an exemplary embodiment, gasket 24 is extruded, molded, or otherwise formed from a resilient, flexible material such as 20A-60A durometer ethylene propylene diene monomer (EPDM) rubber. In an exemplary embodiment, adhesive layer 26 is a pressure sensitive adhesive (PSA) commercially available from 3M Company of St. Paul, MN under model no. 9672LE, though other adhesives are also suitable. It can be seen that gasket 24 includes two connected and parallel tubes 28 and 30. While both tubes 28, 30 are shown with a circular cross-sectional shape, it is contemplated that other closed geometric shapes, such as ovals, ellipses, and polygons are also suitable. Exterior tube 28 and interior tube 30 are joined at bases 32. Adhesive layer 26 is disposed on an outside of one or both bases 32.

In an exemplary embodiment, gasket 24 is symmetrical so that the interior tube 28 and the exterior tube 30 are interchangeable, and either base 32 (or both bases 32) can have adhesive 26 (and optionally release liner 27) applied thereto. In other embodiments, the interior and exterior tubes could be different from each other; for example, the exterior tube 28 could have a larger diameter than the interior tube 30 to form a more robust seal against exterior elements. Having two tubes 28, 30 offers extra security and redundancy in case there is a leak or crack in one tube. Additionally, having bases 32 span the length of both tubes 28, 30 on both sides (top and bottom) of the tubes creates a wide and stable attachment surface on the exterior of gasket 24. The provision of cylindrical tubes 28, 30 within the gasket structure offers firm internal support for the exterior surface.

Figure 7:
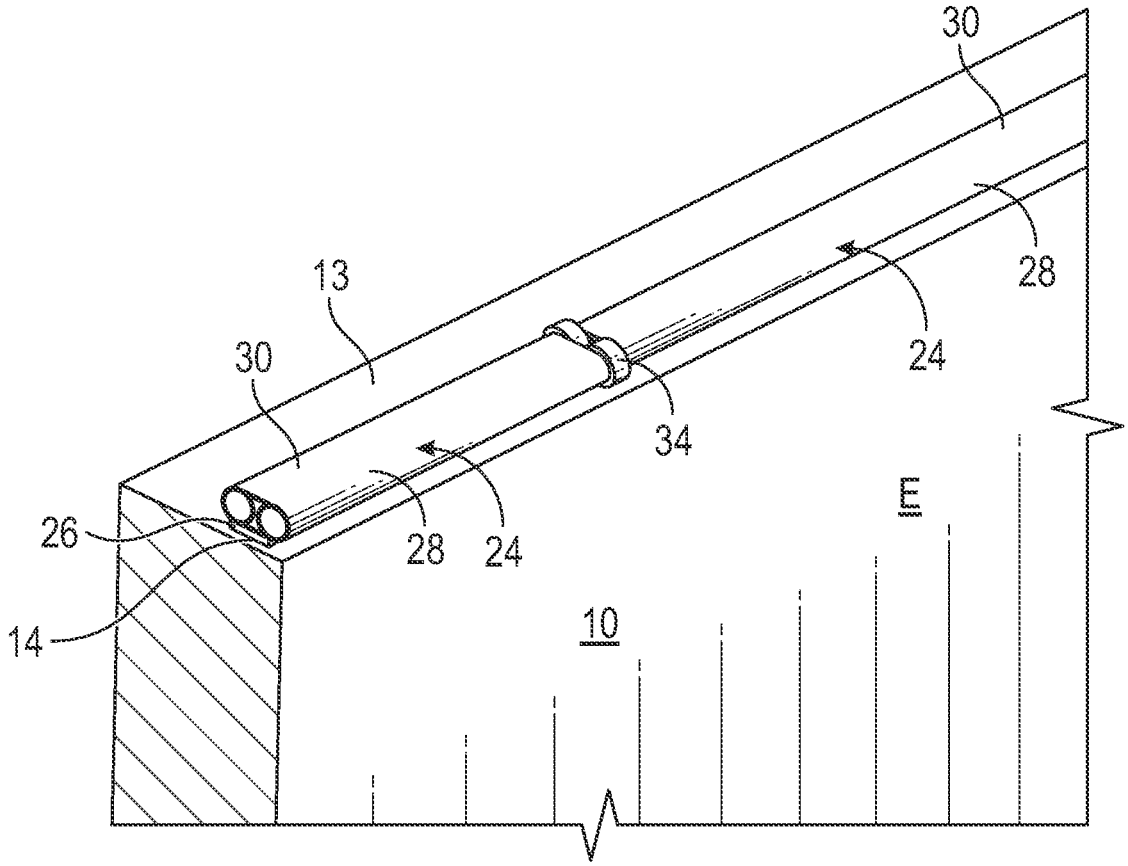
FIG. 7 is a partial perspective view of two sections of the second exemplary gasket connected with a coupling connector.
Figure 8C:
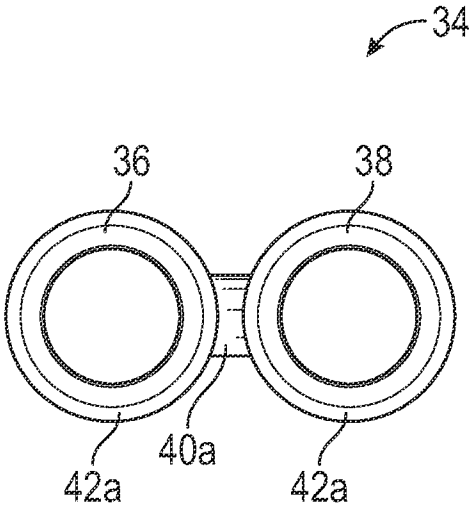
FIG. 8C is an end elevation view of the coupling connector.
Figure 8B:
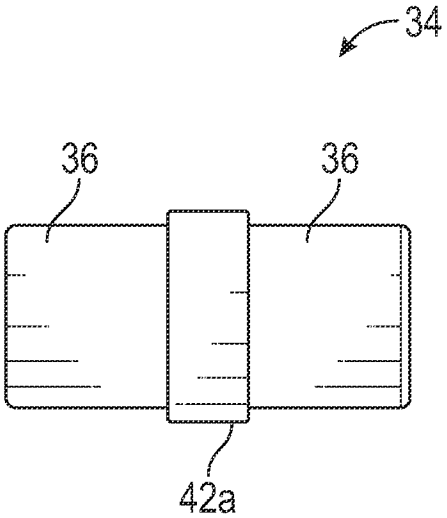
FIG. 8B is a side elevation view of the coupling connector.
Figure 8A:
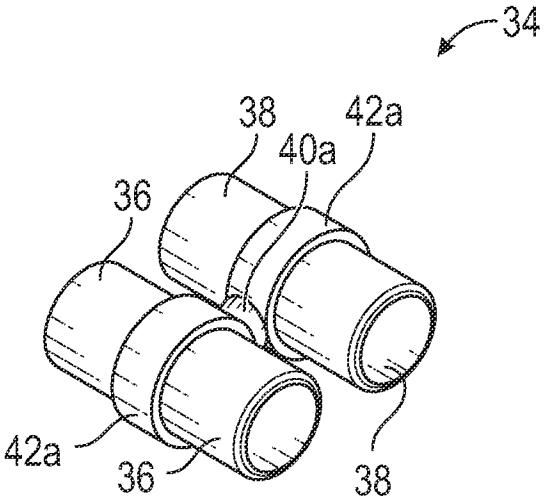
FIG. 8A is a perspective view of the coupling connector of FIG. 7.

FIG. 7 is a partial perspective view of two exemplary gaskets 24 connected with a coupler 34. Such connection is appropriate along an edge face 13 of wall panel 10 that is longer than a piece of gasket 24. FIG. 7 shows the exterior side E of wall panel 10; gasket 24 is positioned thereon with exterior tube 28 facing an exterior of the wall panel 10 and with interior tube 30 facing an interior of wall panel 10. Thus, the double tubes 28, 30, when compressed between adjacent wall panels 10 at joint 22, form a robust seal against element intrusion at engagement interface 12, 14. FIG. 8A is a perspective view of the coupler 34; FIG. 8B is a side elevation view of the coupler 34; and FIG. 8C is an end elevation view of the coupler 34. In an exemplary embodiment, coupler 34 includes four connected barrels, including a pair of exterior barrels 36 and a pair of interior barrels 38. Exterior barrels 36 and interior barrels 38 are joined together by link 40*a*, which includes reinforcement structure 42*a* around end portions of the exterior barrels 36 and interior barrels 38. Exterior tube 28 of gasket 24 is configured to fit over exterior barrel 36 and interior tube 30 of gasket 24 is configured to fit over interior barrel 38. Thus, many gaskets 24 can be linked by connectors 34 in series to effectively provide a gasket assembly of any desired length to cover a structure such as edge face 13 of wall panel 10. In an exemplary embodiment, the gaskets 24 are adhered to a surface of the edge face 13 by adhesive layer 26. If a gasket 24 is longer than desired, it is easily cut to an appropriate length using standard hand tools.

Figure 9:
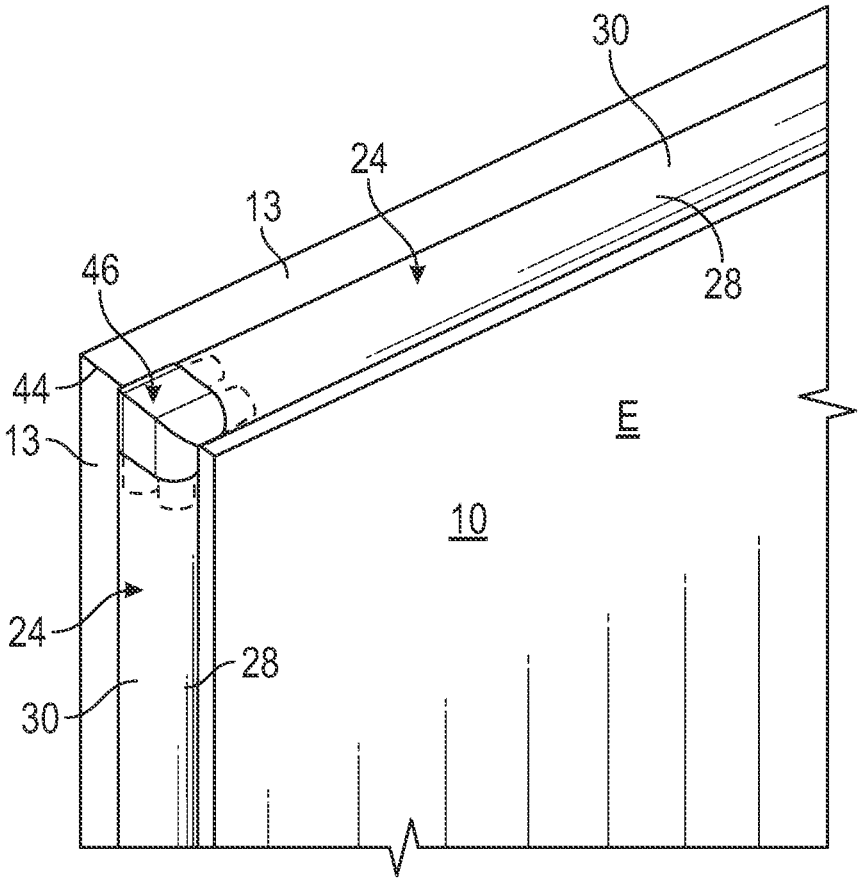
FIG. 9 is a partial perspective view of two sections of the exemplary gasket connected with a two-way connector at an "outside" corner.
Figure 10C:
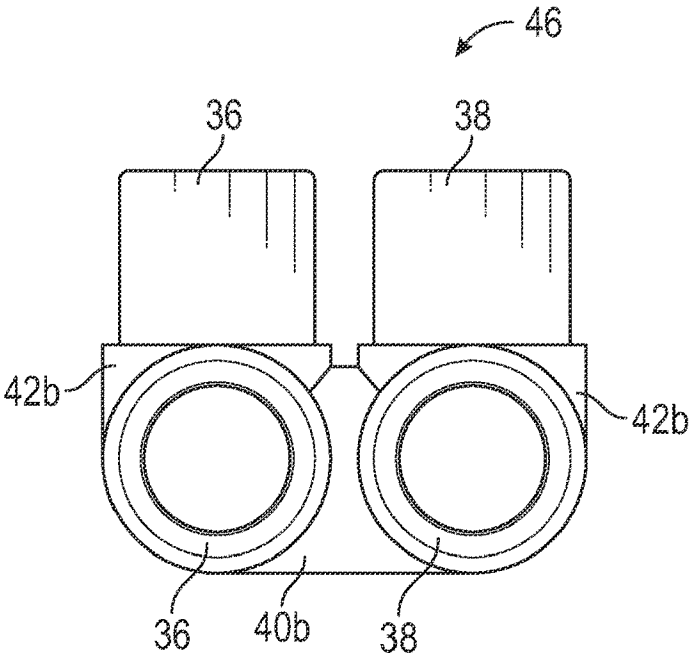
FIG. 10C is an end elevation view of the two-way connector.
Figure 10B:
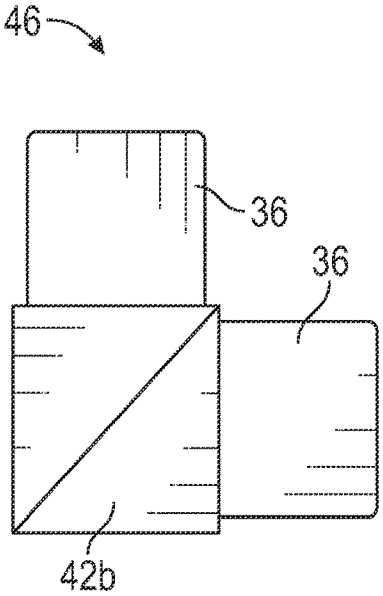
FIG. 10B is a side elevation view of the two-way connector.
Figure 10A:
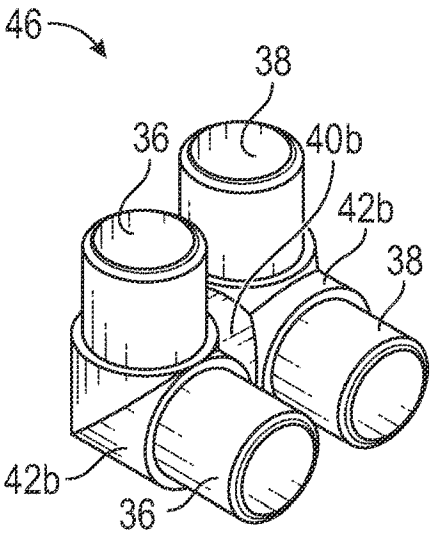
FIG. 10A is a perspective view of the two-way connector.

FIG. 9 is a partial perspective view of two exemplary gaskets 24 connected with a two-way connector 46 at an "outside" corner 44 of wall panel 10. While not explicitly shown, two-way connector 46 can also connect two gaskets 24 at an "inside" corner (oriented as in FIG. for example). FIG. 9 shows the exterior side E of wall panel 10; gasket 24 is positioned thereon with exterior tube 28 facing an exterior of the wall panel 10 and with interior tube 30 facing an interior of wall panel 10. Thus, the double tubes 28, 30, when compressed between adjacent wall panels 10 at joint 22, form a robust seal against element intrusion at engagement interface 14. FIG. 10A is a perspective view of the right angle two-way connector 46; FIG. 10B is a side elevation view of the two-way connector 46; and FIG. 10C is an end elevation view of the two-way connector 46. In an exemplary embodiment, two-way connector 46 includes four connected barrels, including a pair of exterior barrels 36 and a pair of interior barrels 38. The two exterior barrels 36 are oriented at a right angle; the two interior barrels 38 are similarly oriented at a right angle. Exterior barrels 36 and interior barrels 38 are joined together by link which includes reinforcement structure 42*b* around end portions of the exterior barrels 36 and interior barrels 38. Exterior tube 28 of gasket 24 is configured to fit over exterior barrel 36 and interior tube 30 of gasket 24 is configured to fit over interior barrel 38. In all assemblies of gasket 24 with any coupler 34, 46, 48, 50, a sealant or adhesive may be applied between the exterior surface of a barrel 36, 38 and an interior surface of the gasket tube 28, 30.

Figure 11C:
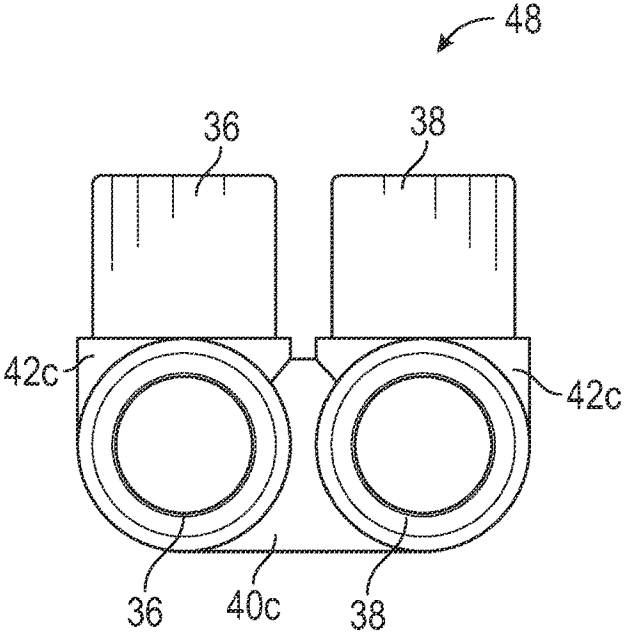
FIG. 11C is an end elevation view of the three-way connector.
Figure 11B:
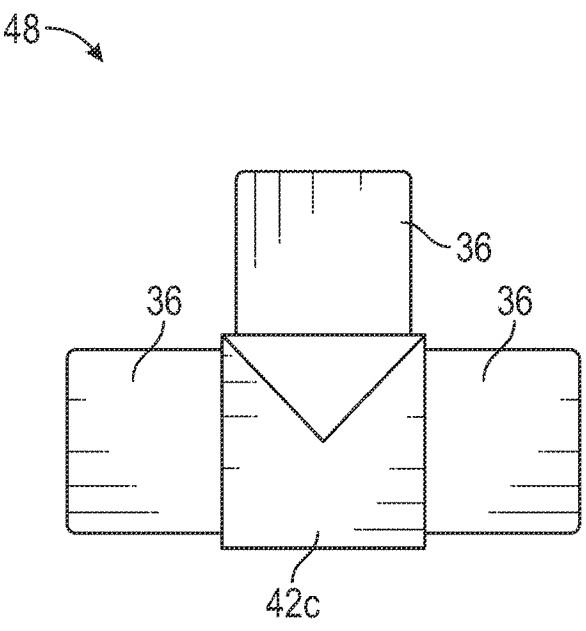
FIG. 11B is a side elevation view of the three-way connector.
Figure 11A:
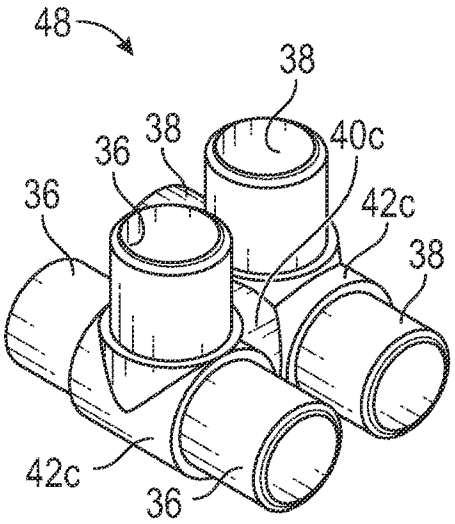
FIG. 11A is a perspective view of a three-way connector.
Figure 12:
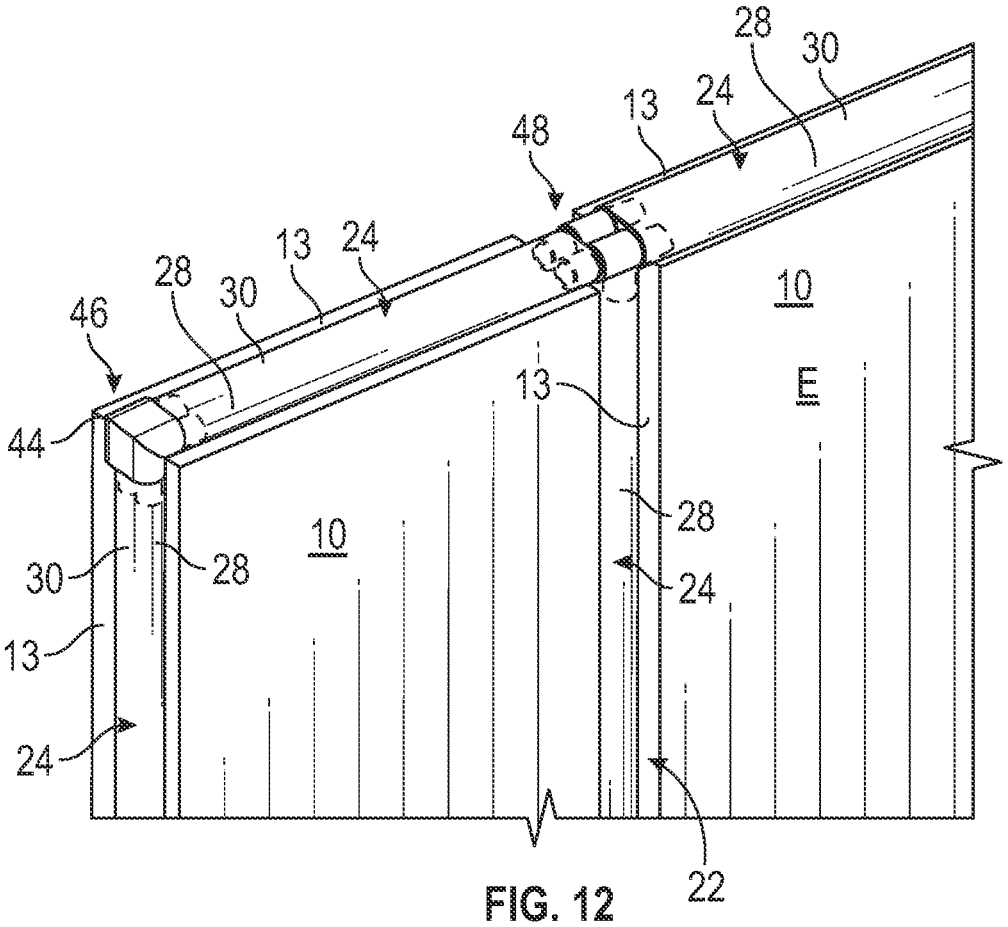
FIG. 12 is a partial perspective view of four sections of the exemplary gasket connected with a two-way connector at an "outside" corner and with a three-connector at a joint between two wall panels.

FIG. 11A is a perspective view of a three-way connector 48; FIG. 11B is a side elevation view of the three-way connector 48; and FIG. 11C is an end elevation view of the three-way connector 48. Such a three-way connector 48 is especially suitable where two wall panels 10 are joined side-by-side above or below another wall panel 10, but not at a joint 22 at the top or bottom edge face 13. In an exemplary embodiment, three-way connector 48 includes six connected barrels, including three mutually orthogonal exterior barrels 36 and three mutually orthogonal interior barrels 38. Exterior barrels 36 and interior barrels 38 are joined together by link 40*c*, which includes reinforcement structure 42*c* around end portions of the exterior barrels 36 and interior barrels 38. Exterior tube 28 of gasket 24 is configured to fit over exterior barrel 36 and interior tube 30 of gasket 24 is configured to fit over interior barrel 38. Link 40 (referring to all embodiments of links 40*a*, 40*b*, 40*c*, 40*d*) can include solid material that fills an interior of barrels 36, 38 at their respective bases. However, an embodiment that provides an open channel in link 40 between the ends of the barrels 36, 38 can alternatively be used to allow for greater compression of the connectors 34, 46, 48, 50 at joints 22, and to allow for fluid communication between adjacent gaskets 24 joined end-to-end by a connector 34, 46, 48, 50.

Figure 13C:
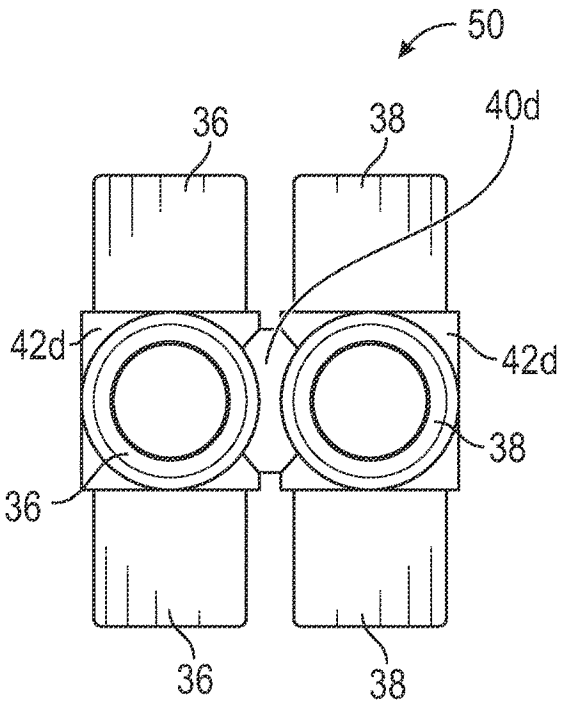
FIG. 13C is an end elevation view of the four-way connector.
Figure 13B:
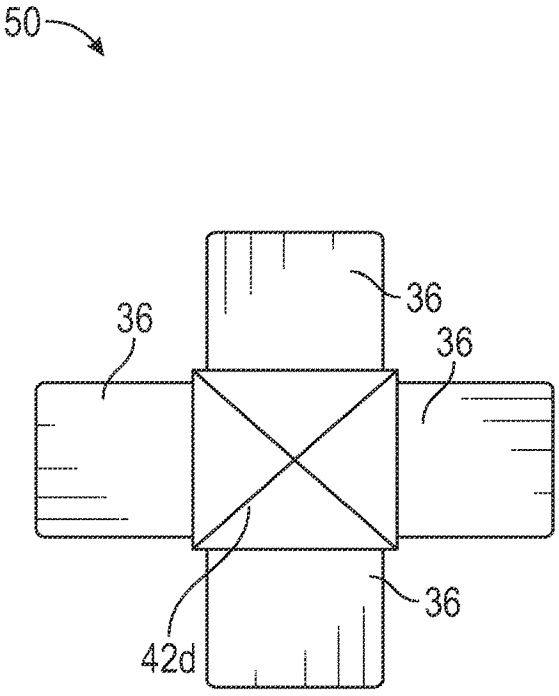
FIG. 13B is a side elevation view of the four-way connector.
Figure 13A:
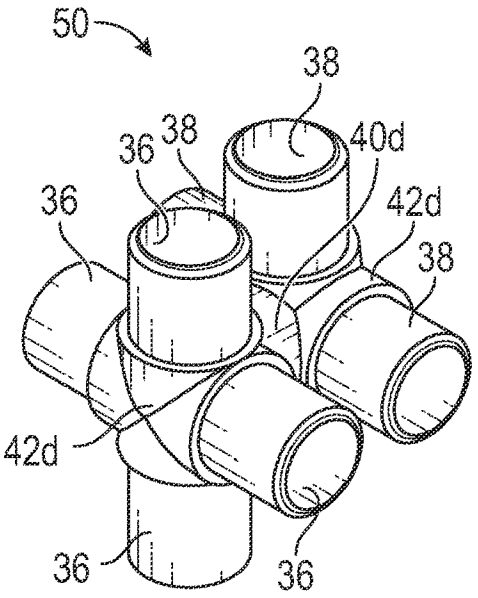
FIG. 13A is a perspective view of a four-way connector.
Figure 14:
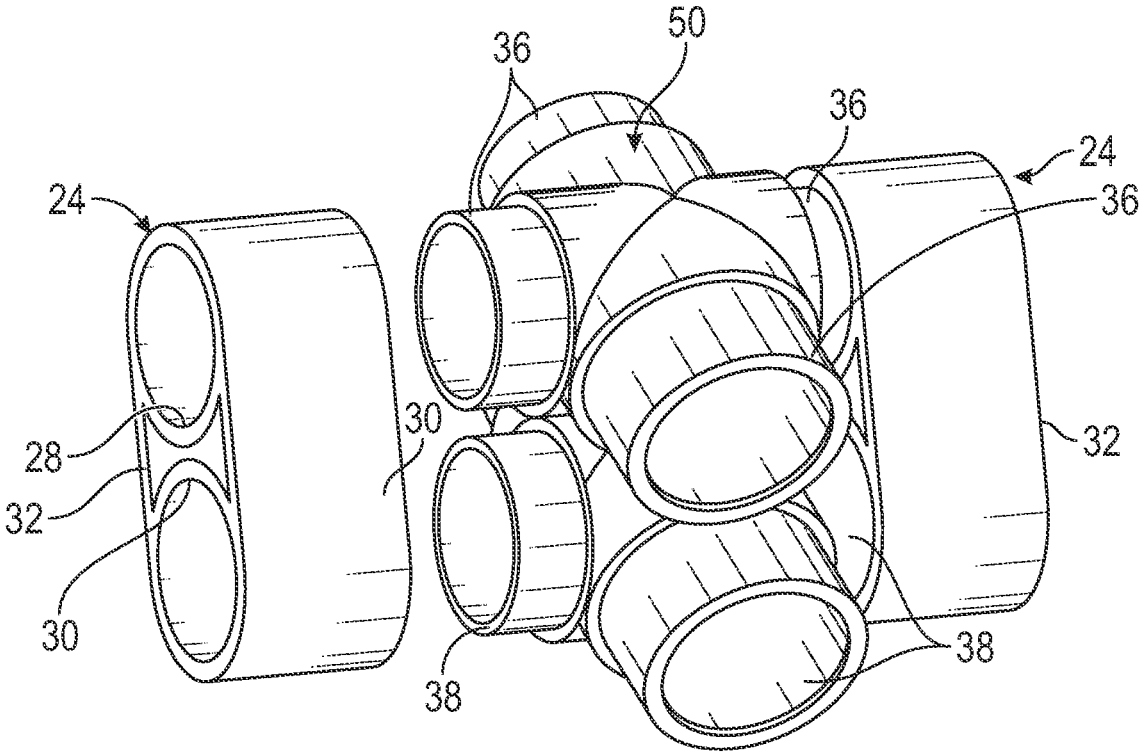
FIG. 14 is a perspective view of the four-way connector with a gasket segment connected thereto and a gasket segment positioned for connection thereto.
Figure 15:
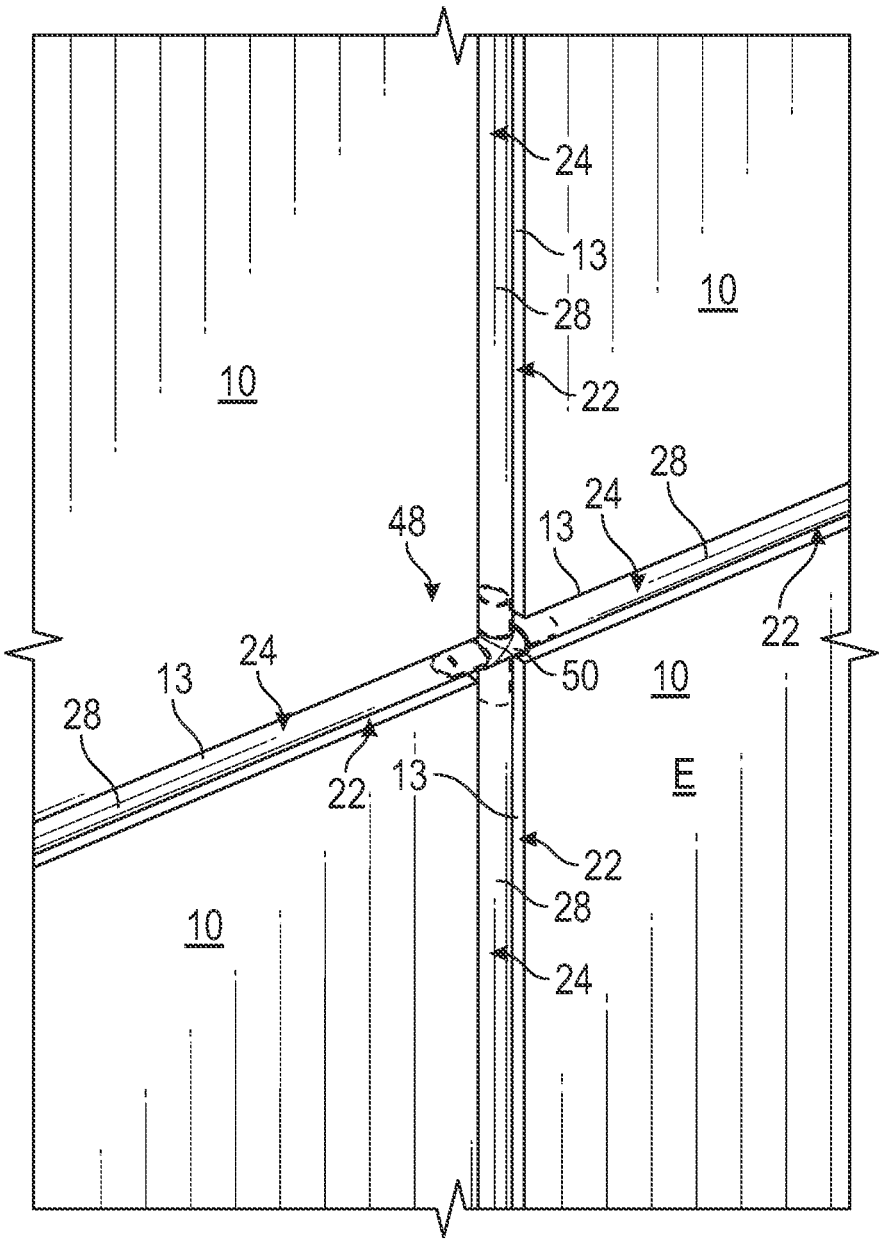
FIG. 15 is a partial perspective view of four exemplary gaskets connected with a four-way connector at an intersection joint between four wall panels.

FIG. 13A is a perspective view of a four-way connector 50; FIG. 13B is a side elevation view of the four-way connector 50; FIG. 13C is an end elevation view of the four-way connector 50; and FIG. 14 is a perspective view of the four-way connector 50 with gasket segments. Such a four-way connector 50 is especially suitable where four wall panels 10 are joined at a single intersection, such as shown in FIG. 15. In an exemplary embodiment, four-way connector 50 includes eight connected barrels, including four mutually orthogonal exterior barrels 36 and four mutually orthogonal interior barrels 38. Exterior barrels 36 and interior barrels 38 are joined together by link 40*d*, which includes reinforcement structure 42*d* around end portions of the exterior barrels 36 and interior barrels 38. As shown in FIG. 14, exterior tube 28 of gasket 24 is configured to fit over exterior barrel 36 and interior tube 30 of gasket 24 is configured to fit over interior barrel 38. In some cases, a sealant may be disposed between the tube and respective barrel to aid in adhesion and sealing. In FIG. 14, only a short segment of gaskets 24 is shown for ease of illustration. While a friction fit is illustrated, other coupling features and configurations can be used, such as the use of snap-connecting structures, for example.

In exemplary embodiments, coupler 34 is formed so that adjacent and connected gaskets 24 are aligned generally linearly via coupler 34, and connectors 46, 48 and 50 are formed to define 90° connections between adjacent and connected gaskets 24. It is contemplated that coupler 34 and connectors 46, 48 and 50 may be formed to make gasket connections at angles other than 180° and 90°, such as other obtuse or acute angles between connected gaskets 24, depending on the design and configuration of the wall panels 10 and their assembly, as desired to make an effective seal therebetween.

In an exemplary embodiment, gasket 24 and each of connectors 34, 46, 48, 50 is formed of a resilient, compressible, durable, ultraviolet (UV) light resistant and weather resistant material. Suitable materials include, for example, EPDM (ethylene propylene diene monomer) rubber, a thermoplastic elastomer (TPE) mix of plastic and rubber, a thermoplastic olefin (TPO) polymer/filler blend, silicone, and combinations thereof. Connectors 34, 46, 48, 50 may be formed of a EPDM to be stiffer than gasket 24, for example. With the currently described system, the gaskets 24 and connectors 34, 46, 48, 50 can be applied to typically two to three edges of the wall panel 10 at the fabrication factory, so that no post-installation sealing is required after the system of wall panels is assembled together to clad the exterior surface of a building. A wall panel system installed using the disclosed gaskets is impervious to moisture and air penetration at joints 22 between the wall panels 10, and such protection is durable to withstand environmental elements over time. In another embodiment, gaskets 24 are applied to all edge faces 13 of a wall panel 10 at the fabrication point. Alternatively, gaskets 24 can be applied to one or more edge faces 13 of a wall panel 10 at the structure assembly site, before adjacent panels are mounted.

Non-limiting, exemplary embodiments of a system and method are described. In FIGS. 7, 9, 12 and 15, various components of the system are illustrated with wall panels, in which the system components are visible, to aid in understanding how the components cooperate. However, it is contemplated that in use, the gasket system components could be recessed from the exterior surface (such as shown in FIG. 4, for example) to be visually unobtrusive.

In In an exemplary embodiment, a compressible, elongated gasket 24 comprises first and second tubes 28, 30 aligned side-by-side and connected to each other along their common length by a first base 32 and a second base 32, each of the first base 32 and second base 32 contacting both the first tube 28 and the second tube 30. In an exemplary embodiment, an adhesive 26 is disposed on at least one of the first base 32 and the second base 32.

In an exemplary embodiment, a system comprises a compressible coupler 34, 46, 48, configured to connect a plurality of said gaskets 24. In an exemplary embodiment, the coupler 34, 46, 48, 50 comprises a first set of first and second barrels 36, 38 configured to engage the first and second tubes 28, 30, respectively, of a first gasket 24 of the plurality of said gaskets 24. In an exemplary embodiment, the coupler 34, 46, 48, 50 comprises a second set of first and second barrels 36, 38 configured to engage the first and second tubes 28, 30, respectively, of a second gasket 24 of the plurality of said gaskets 24.

In an exemplary embodiment of coupler 34, 48, 50, the first set and the second set are aligned along a common linear orientation. In an exemplary embodiment of connector 46, 48, the first set and the second set have a mutually orthogonal orientation. In an exemplary embodiment, connector 48, 50 comprises a third set of first and second barrels 36, 38 configured to engage the first and second tubes 28, 30, respectively, of a third gasket 24 of the plurality of said gaskets 24. In an exemplary embodiment of connector 48, 50, the first set and the second set are aligned along a common linear orientation; and the first set and the third set have a mutually orthogonal orientation. In an exemplary embodiment, connector 50 comprises a fourth set of first and second barrels 36, 38 configured to engage the first and second tubes 28, 30, respectively, of a fourth gasket 24 of the plurality of said gaskets 24. In an exemplary embodiment of connector 50, the first set, second set, third set and fourth set have mutually orthogonal orientations.

In an exemplary embodiment, a first wall panel 10 comprises a first edge face 13, wherein a first said gasket 24 is attached to the first edge face 13. In an exemplary embodiment, a second wall panel 10 comprises a second edge face 13, wherein the first said gasket 24 is compressed between the first edge face 13 and the second edge face 13. In an exemplary embodiment, one of the first and second bases 32 of the first said gasket 24 is attached to the first edge face 13. In an exemplary embodiment, the first wall panel 10 comprises a second edge face 13, and wherein a second said gasket 24 is attached to the second edge face 13. In an exemplary embodiment, the first wall panel 10 comprises a third edge face 13, and a third said gasket 24 is attached to the third edge face 13.

In an exemplary embodiment, a method for sealing a joint 22 between first and second wall panels 10 is described. The method comprises obtaining a first compressible, elongated gasket 24; positioning the first gasket 24 on an edge face 13 of the first wall panel 10; attaching the first gasket 26 to the edge face 13 of the first wall panel 10; and placing the second wall panel 10 adjacent to the first wall panel 10 to compress the first gasket 24 therebetween. In an exemplary embodiment, the first wall panel 10 has an exterior side E and an interior side I, wherein positioning the first gasket 24 on the edge face 13 of the first wall panel 10 comprises aligning the first tube 28 proximate the exterior side E and aligning the second tube 30 proximate the interior side I. In an exemplary embodiment, attaching the first gasket 24 comprises adhering one of the first base 32 or second base 32 to the edge face 13 of the first wall panel 10. In an exemplary embodiment, the method comprises obtaining a second said compressible, elongated gasket 34 and a connector 36, 46, 48, 50, the method comprising attaching the connector 36, 46, 48, 50 between the first gasket 24 and the second gasket 24.

Although the subject of this disclosure has been described with reference to several embodiments, workers skilled in the art will recognize that changes may be made in form and detail without departing from the scope of the disclosure. For example, while the illustrated embodiments of tubes 28, 30 and barrels 36, 38 of connectors 34, 46, 48, 50 are depicted as cylindrical, it is contemplated that other mutually engageable shapes can also be used. In addition, any feature disclosed with respect to one embodiment may be incorporated in another embodiment, and vice-versa.

The invention claimed is:

1. A system comprising:

a compressible, elongated gasket comprising first and second tubes aligned side-by-side and connected to each other along their common length by a first base and a second base, each of the first base and second base contacting both the first tube and the second tube; and a compressible connector configured to connect a plurality of said gaskets.

2. The system of claim 1, comprising an adhesive disposed on at least one of the first base and the second base.

3. The system of claim 1, wherein the connector comprises a first set of first and second barrels configured to engage the first and second tubes, respectively, of a first gasket of the plurality of said gaskets.

4. The system of claim 3, wherein the connector comprises a second set of first and second barrels configured to engage the first and second tubes, respectively, of a second gasket of the plurality of said gaskets.

5. The system of claim 4 wherein the first set and the second set are aligned along a common linear orientation.

6. The system of claim 4 wherein the first set and the second set have a mutually orthogonal orientation.

7. The system of claim 4, wherein the connector comprises a third set of first and second barrels configured to engage the first and second tubes, respectively, of a third gasket of the plurality of said gaskets.

8. The system of claim 7 wherein:

the first set and the second set are aligned along a common linear orientation; and the first set and the third set have a mutually orthogonal orientation.

9. The system of claim 7, wherein the connector comprises a fourth set of first and second barrels configured to engage the first and second tubes, respectively, of a fourth gasket of the plurality of said gaskets.

10. The system of claim 9 wherein the first set, second set, third set and fourth set have mutually orthogonal orientations.

11. The system of claim 1 comprising a first wall panel comprising a first edge face, wherein a first said gasket is attached to the first edge face.

12. The system of claim 11 comprising a second wall panel comprising a second edge face, wherein the first said gasket is compressed between the first edge face and the second edge face.

13. The system of claim 11 wherein one of the first and second bases of the first said gasket is attached to the first edge face.

14. The system of claim 11 wherein the first wall panel comprises a second edge face, and wherein a second said gasket is attached to the second edge face.

15. The system of claim 14 wherein the first wall panel comprises a third edge face, and wherein a third said gasket is attached to the third edge face.

16. A method for sealing a joint between first and second wall panels, the method comprising:

obtaining a first compressible, elongated gasket comprising first and second tubes aligned side-by-side and connected to each other along their common length by a first base and a second base, each of the first base and second base contacting both the first tube and the second tube;

positioning the first gasket on an edge face of the first wall panel;

attaching the first gasket to the edge face of the first wall panel;

obtaining a second said compressible, elongated gasket and a connector, the method comprising attaching the connector between the first gasket and the second gasket; and placing the second wall panel adjacent to the first wall panel to compress the first gasket therebetween.

17. The method of claim 16 wherein the first wall panel has an exterior side and an interior side, wherein positioning the first gasket on the edge face of the first wall panel comprises aligning the first tube proximate the exterior side and aligning the second tube proximate the interior side.

18. The method of claim 16 wherein attaching the first gasket comprises adhering one of the first base or second base to the edge face of the first wall panel.

* * * * *